US008419920B2

(12) United States Patent
Tomonaga et al.

(10) Patent No.: US 8,419,920 B2
(45) Date of Patent: Apr. 16, 2013

(54) METHOD OF PREPARING ELECTROLYTIC COPPER SOLUTION ACIDIFIED WITH SULFURIC ACID, SULFURIC-ACID-ACIDIFIED ELECTROLYTIC COPPER SOLUTION PREPARED BY THE PREPARATION METHOD, AND ELECTRODEPOSITED COPPER FILM

(75) Inventors: Sakiko Tomonaga, Tokyo (JP); Makoto Dobashi, Saitama (JP); Junshi Yoshioka, Saitama (JP); Ayumu Tateoka, Saitama (JP); Mitsuyoshi Matsuda, Saitama (JP); Hisao Sakai, Saitama (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 727 days.

(21) Appl. No.: 12/444,020

(22) PCT Filed: Oct. 2, 2007

(86) PCT No.: PCT/JP2007/069294

§ 371 (c)(1),
(2), (4) Date: Jun. 29, 2009

(87) PCT Pub. No.: WO2008/041706

PCT Pub. Date: Apr. 10, 2008

(65) Prior Publication Data

US 2010/0089758 A1 Apr. 15, 2010

(30) Foreign Application Priority Data

Oct. 3, 2006 (JP) ..... 2006-272327

(51) Int. Cl.
*C25D 3/38* (2006.01)

(52) U.S. Cl.
USPC ..... 205/296; 205/298

(58) Field of Classification Search ..... 205/296, 205/298
See application file for complete search history.

(56) References Cited

U.S. PATENT DOCUMENTS 6,881,319 B2 * 4/2005 Seita et al. ..... 205/296
2004/0104117 A1 6/2004 Yang et al. ..... 205/76

(Continued)

FOREIGN PATENT DOCUMENTS

JP 2004-35918 2/2004
JP 2004-162172 6/2004

(Continued)

OTHER PUBLICATIONS

Frank et al., "The Decomposition of the Sulfonate Additive Sulfopropyl Sulfonate in Acid Copper Electroplating Chemistries", J. of the Electrochem. Soc. (no month, 2003), vol. 150, No. 4, pp. C244-C250.*

(Continued)

*Primary Examiner* — Edna Wong
(74) *Attorney, Agent, or Firm* — Greenblum & Bernstein, P.L.C.

(57) ABSTRACT

An object of the present invention is to provide a method for preparing a sulfuric acid base copper electrolytic solution used for formation of an electro-deposited copper film comprising a surface excellent in smoothness and gloss when formed by using the solution just after preparation and is prepared by using mono-sulfides. To achieve the object, a sulfuric acid base copper electrolytic solution is made to contain a sulfonated active sulfur compound, the bis(3-sulfopropyl)disulfide which is recommended for formation of a glossy electro-deposited copper film. And the bis(3-sulfopropyl)disulfide contained is obtained by converting a 3-mercapto-1-propanesulfonic acid into the bis(3-sulfopropyl)disulfide in an aqueous solution of the 3-mercapto-1-propanesulfonic acid by an oxidation reaction. In the oxidation reaction, an air bubbling method is preferably used to prevent oxidative decomposition of the 3-mercapto-1-propanesulfonic acid.

11 Claims, 1 Drawing Sheet

U.S. PATENT DOCUMENTS

| | | | | |
|---|---|---|---|---|
| 2004/0187731 | A1 * | 9/2004 | Wang et al. | 106/1.13 |
| 2005/0072683 | A1 | 4/2005 | Nakada et al. | 205/296 |

FOREIGN PATENT DOCUMENTS

| | | |
|---|---|---|
| JP | 2005-126803 | 5/2005 |
| JP | 2005-171347 | 6/2005 |
| JP | 2006-111976 | 4/2006 |

OTHER PUBLICATIONS

D'Urzo et al., "SPE-HPLC Detection of Organic Additives in Acidic Copper Plating Baths", J. of the Electrochem. Soc. (no month, 2005), vol. 152, No. 4, pp. C243-C247.*

U.S. Appl. No. 12/298,068, filed Oct. 22, 2008, and entitled "Electro-Deposited Copper Foil, Surface-Treated Copper Foil Using the Electro-Deposited Copper Foil and Copper Clad Laminate Using the Surface-Treated Copper Foil, and a Method for Manufacturing the Electro-Deposited Copper Foil."

U.S. Appl. No. 12/282,231, filed Sep. 9, 2008, and entitled "Surface-Treated Electro-Deposited Copper Foil and Method for Manufacturing the Same."

U.S. Appl. No. 12/089,671, filed Apr. 9, 2008, and entitled "Production Method of Electro-Deposited Copper Foil, Electro-Deposited Copper Foil Obtained by the Production Method, Surface-Treated Copper Foil Obtained by Using the Electro-Deposited Copper Foil and Copper-Clad Laminate Obtained by Using the Electro-Deposited Copper Foil or the Surface-Treated Copper Foil."

U.S. Appl. No. 11/910,050, filed Sep. 28, 2007, and entitled "Electrodeposited Copper Foil, Its Manufacturing Method, Surface-Treated Electrodeposited Copper Foil Using the Electrodeposited Copper."

* cited by examiner

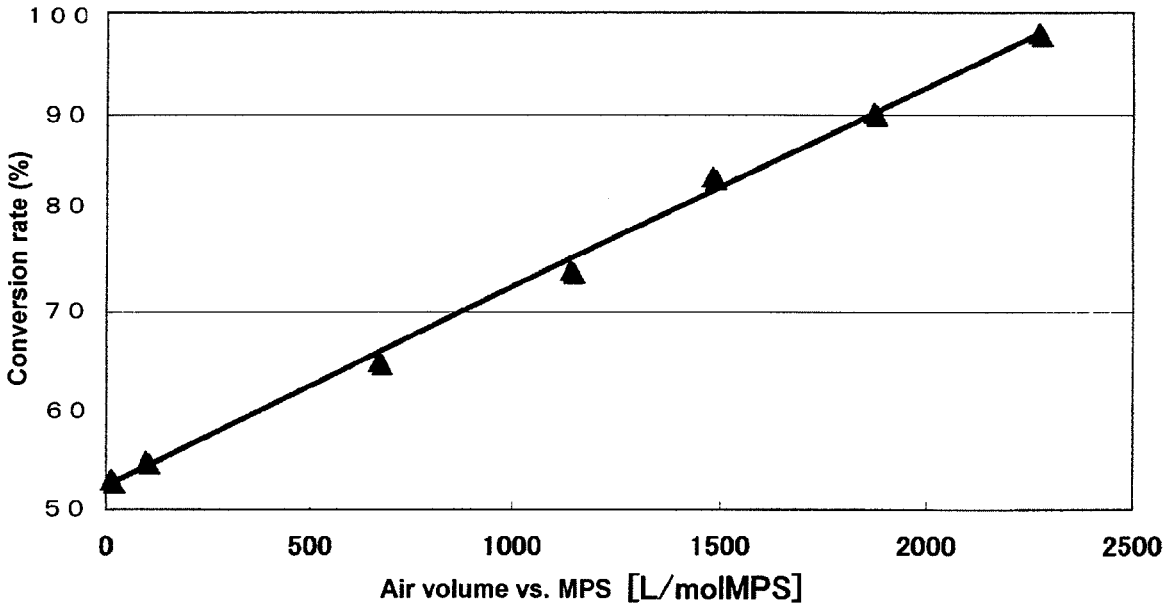
100
90
80
70
60
50
Conversion rate (%)
0
500
1000
1500
2000
2500
Air volume vs. MPS [L/molMPS]

METHOD OF PREPARING ELECTROLYTIC COPPER SOLUTION ACIDIFIED WITH SULFURIC ACID, SULFURIC-ACID-ACIDIFIED ELECTROLYTIC COPPER SOLUTION PREPARED BY THE PREPARATION METHOD, AND ELECTRODEPOSITED COPPER FILM

TECHNICAL FIELD

The present invention relates to a method for preparing a sulfuric acid base copper electrolytic solution, a sulfuric acid base copper electrolytic solution prepared by using the method for preparing a sulfuric acid base copper electrolytic solution, and an electro-deposited copper film obtained by using the sulfuric acid base copper electrolytic solution.

BACKGROUND ART

Copper metal has historically been used for ornamental uses in buildings. Recently, even for such ornamental copper products, to minimize the copper consumption, glossy copper plated on a resin article or the like has been often employed. In addition, copper is a good electric conductor and is not so expensive and easy to handle. Therefore, application of copper as a forming material in electric circuits has been expanding in recent generation. In the electronic circuit industry, surface mounting of electronic devices has been popular. Especially, as mounting of the devices on via holes are performed, to form filled via holes, copper plating is mainly employed. Further, for package substrates on which an IC chips are directly mounted, the pads for wire bonding may also be formed by copper plating. In such partially-plated copper plating, to minimize amount of plated gold on the surface and to improve connection reliability, the surface of plated copper film obtained by electro-deposition is required to be smooth and gloss.

Various technical developments have been carried out to satisfy such requirements described above. For example, Patent Document 1 discloses a technology in which a CV method is used to confirm whether a good electro-deposited film is obtained by using the bis(3-sulfopropyl)disulfideas an additive in a sulfuric acid base copper electrolytic solution for via filling. Next, Patent Document 2 discloses a technology managing a concentration of the oxygen in an electrolytic solution comprising a disulfide brightener to prevent the generation of a mono-sulfide which is generated by reductive decomposition in an electrolysis operation and adversely affect the plated film.

As can be understood from the technologies disclosed in Patent Documents 1 and 2, it is well known to use an active sulfur compound sulfonate as a brightener in a sulfuric acid base copper electrolytic solution.

[Patent Document 1] Japanese Patent Laid-Open No. 2005-171347

[Patent Document 2] Japanese Patent Laid-Open No. 2006-111976

DISCLOSURE OF THE INVENTION

Problems to be Solved by the Invention

However, it is commonly recognized that the bis(3-sulfopropyl)disulfide as a disulfide is effective in a sulfuric acid base copper electrolytic solution to obtain a bright plated copper film. On the other hand, although effects in improving the gloss of a plated copper film may be obtained when a mono-sulfide is added to the copper electrolytic solution, but it lacks stability as a copper plating solution, and it is said that a phenomenon in which the gloss of the plated copper film is adversely affected may sometimes occur. Therefore, it is recommended to use an additive, the bis(3-sulfopropyl)disulfide as a disulfide in the sulfuric acid base copper electrolytic solution.

However, even if a bis(3-sulfopropyl)disulfide salt should be used as a bath component in preparation of the electrolytic solution, there are not many kinds of the bis(3-sulfopropyl) disulfide salts in the market and are expensive. As a result, the running costs of the copper plating process may substantially increase. It means that the case using the bis(3-sulfopropyl) disulfide may be limited in conventional industrial processes.

In contrast, mono-sulfides which are said to adversely affect the gloss of a plated copper film, have the advantages that many kinds of chemical may be easily purchased in the market and are not so expensive. Therefore, if a plated copper film with a gloss level equivalent to that obtained by using a copper electrolytic solution which contain disulfides could be obtained by using a copper electrolytic solution which contain mono-sulfides as an additive, bright plating of a copper in conventional industrial processes may be carried out without increasing of the running costs in the copper plating process.

Thus, an object of the present invention is to provide a method for preparing a sulfuric acid base copper electrolytic solution used for formation of an electro-deposited copper film comprising a surface excellent in smoothness and gloss when formed by using the solution just after preparation and is prepared by using mono-sulfides.

Means to Solve the Problems

Therefore, as a result of extensive research, the present inventors have thought out a method for preparing the following sulfuric acid base copper electrolytic solution. Simply stated, the technical concept comprised in the present invention is, when a sulfuric acid base copper electrolytic solution for formation of an electro-deposited copper film excellent in gloss is prepared, a mono-sulfide compound which is hard to form an electro-deposited copper film excellent in gloss when just added to the sulfuric acid base copper electrolytic solution is converted into disulfides in an aqueous solution including cupric ions. And then the solution containing disulfide is mixed to a copper sulfate electrolytic solution to obtain a sulfuric acid base copper electrolytic solution which stably enables formation of an electro-deposited copper film excellent in gloss.

Method for Preparing a Sulfuric Acid Base Copper Electrolytic Solution According to the Present Invention:

The method for preparing a sulfuric acid base copper electrolytic solution according to the present invention is characterized in comprising the steps A to C.

Step A: A step of preparing an initial aqueous solution by adding the 3-mercapto-1-propanesulfonic acid, which is a sulfonated active sulfur compound, to an aqueous solution containing cupric ions.

Step B: A step of preparing a conversion solution by converting a part or all of the 3-mercapto-1-propanesulfonic acid into the bis(3-sulfopropyl)disulfide by utilizing an oxidation reaction in the initial aqueous solution.

Step C: A step of preparing a sulfuric acid base copper electrolytic solution by adding the conversion solution to a copper sulfate-containing solution.

In the method for preparing a sulfuric acid base copper electrolytic solution according to the present invention, a concentration of the 3-mercapto-1-propanesulfonic acid in the initial aqueous solution prepared in step A is preferable to be $2.8\times10^{-6}$ mol/L to 2.3 mol/L.

In the method for preparing a sulfuric acid base copper electrolytic solution according to the present invention, the relationship between the concentration of the 3-mercapto-1-propanesulfonic acid and the concentration of the cupric ions in the initial aqueous solution prepared is preferable to satisfy the expression 3 below.

$$\frac{[\text{Cupric ion concentration (mol/L)}]}{[\text{3-mercapto-1-propanesulfonic acid concentration(mol/L)}]} \geq 0.005 \quad \text{[Expression 3]}$$

In the method for preparing a sulfuric acid base copper electrolytic solution according to the present invention, it is preferable in step B that the oxidation reaction is carried out at pH of 4 or less in the initial aqueous solution.

Further, it is preferable in step B of the method for preparing a sulfuric acid base copper electrolytic solution according to the present invention that a forced oxygen introduction means are used for the oxidation reaction. Further, it is preferable that the forced oxygen introduction mean is an air bubbling method in which the flow rate of the air supply is 0.1 L/min or more, and the relationship between a total air volume supplied and the amount of the 3-mercapto-1-propanesulfonic acid contained in the initial aqueous solution satisfies the expression 4 below.

$$\frac{[\text{Total Air Volume (L)}]}{\left[\begin{array}{c}\text{Amount of 3-mercapto-1-}\\ \text{propanesulfonic acid in}\\ \text{initial aqueous solution (mol)}\end{array}\right]} \geq 112 \text{ L/mol} \quad \text{[Expression 4]}$$

In the method for preparing a sulfuric acid base copper electrolytic solution according to the present invention, it is preferable that a concentration of the copper ions in the copper sulfate-containing solution is 0.5 g/L to 100 g/L.

Sulfuric Acid Base Copper Electrolytic Solution According to the Present Invention:

The sulfuric acid base copper electrolytic solution according to the present invention is a sulfuric acid base copper electrolytic solution which is obtained by converting a part or all of the 3-mercapto-1-propanesulfonic acid into the bis(3-sulfopropyl)disulfide by the method for preparing a sulfuric acid base copper electrolytic solution according to the present invention, which is characterized in that a concentration of the bis(3-sulfopropyl)disulfide is $1.4\times10^{-6}$ mol/L to $2.1\times10^{-3}$ mol/L.

In the sulfuric acid base copper electrolytic solution according to the present invention, preferable concentration of the copper ions is 0.5 g/L to 100 g/L.

In the sulfuric acid base copper electrolytic solution according to the present invention, it is preferable to contain 1 ppm to 150 ppm of a quaternary ammonium salt polymer having a ring structure.

Further, as the quaternary ammonium salt polymer having the ring structure, it is preferable to use a diallyldimethylammonium chloride polymer.

Still further, in the sulfuric acid base copper electrolytic solution according to the present invention, preferable concentration of the chloride ion is 5 ppm to 100 ppm.

Electro-Deposited Copper Film According to the Present Invention:

The electro-deposited copper film according to the present invention is characterized in that the electro-deposited copper film is formed by using the above-described sulfuric acid base copper electrolytic solution.

Advantages of the Invention

The method for preparing a sulfuric acid base copper electrolytic solution according to the present invention uses a mono-sulfide compound (3-mercapto-1-propanesulfonic acid is suitable) as an additive, and is converted into a disulfide compound (bis(3-sulfopropyl)disulfide is suitable) in an aqueous solution containing cupric ions. The solution prepared and a copper sulfate electrolytic solution is mixed to prepare a sulfuric acid base copper electrolytic solution. By employing the method for preparing a sulfuric acid base copper electrolytic solution, even though mono-sulfides which is hard to use conventionally is used as an additive for the copper electrolytic solution, an obtained electro-deposited copper film may be equivalent to that when a disulfide is directly used as an additive for a copper electrolytic solution. That is, as purchasing of a mono-sulfide is easier than a disulfide in a lower cost as a chemical, a reduction in the running costs of a copper plating process can be effectively achieved.

BEST MODE FOR CARRYING OUT THE INVENTION

The embodiments relating to the method for preparing a sulfuric acid base copper electrolytic solution, sulfuric acid base copper electrolytic solution, and electro-deposited copper film according to the present invention will be described respectively.

Embodiment of the Method for Preparing a Sulfuric Acid Base Copper Electrolytic Solution According to the Present Invention:

The method for preparing a sulfuric acid base copper electrolytic solution according to the present invention comprises the steps A to C. Steps A to C will be described independently.

Step A:

In the step A, an initial aqueous solution is prepared by adding the 3-mercapto-1-propanesulfonic acid (hereinafter, referred to as "MPS" in the mathematical expressions, chemical formulas, and tables used in the description), which is a sulfonated active sulfur compound, to an aqueous solution containing cupric ions. Here, "the aqueous solution containing cupric ions" is used to achieve a certain level of conversion rate in conversion of the 3-mercapto-1-propanesulfonic acid into the bis(3-sulfopropyl)disulfide (hereinafter, referred to as "SPS" in the mathematical expressions, chemical formulas, and tables used in the description) in the step B described later. Specifically, when no cupric ion is contained in the solution, the 3-mercapto-1-propanesulfonic acid cannot be converted into the bis(3-sulfopropyl)disulfide, and as a result, the object of the present invention cannot be achieved.

A concentration of the 3-mercapto-1-propanesulfonic acid in the initial aqueous solution prepared in the step A is preferable to be 2.8 μmol/L to 2.3 mol/L. The concentration of the 3-mercapto-1-propanesulfonic acid is determined according to the concentration of the bis(3-sulfopropyl)disulfide which should be contained in the finished sulfuric acid base copper electrolytic solution. The relationship between the 3-mercapto-1-propanesulfonic acid and the bis(3-sulfopropyl)disulfide will be described.

Formula 1 represents the chemical structure of the 3-mercapto-1-propanesulfonic acid and Formula 2 represents the chemical structure of the bis(3-sulfopropyl)disulfide as shown below. As can be understood from comparison between the chemical structures, it is obvious that the bis(3-sulfopropyl)disulfide is a dimer of the 3-mercapto-1-propanesulfonic acid.

[Formula 1]

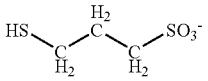

[Formula 2]

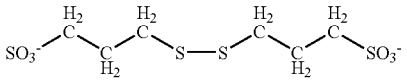

Therefore, even if the conversion rate from the 3-mercapto-1-propanesulfonic acid into the bis(3-sulfopropyl)disulfide is estimated to be 100%, the lower limit of the concentration of the 3-mercapto-1-propanesulfonic acid in the initial aqueous solution must be 2.8 μmol/L, which is twice the lower limit concentration of the bis(3-sulfopropyl)disulfide in the finished sulfuric acid base copper electrolytic solution. On the other hand, the upper limit concentration of the 3-mercapto-1-propanesulfonic acid in the initial aqueous solution is preferably set so that the concentration of the bis(3-sulfopropyl) disulfide obtained by the conversion through an oxidation reaction do not reach to a solubility. The solubility of the 3-mercapto-1-propanesulfonic acid in water at room temperature is 3.46 mol/L. However, the solubility of the bis(3-sulfopropyl)disulfide in water at room temperature is 1.16 mol/L. Therefore, when a conversion rate of the 3-mercapto-1-propanesulfonic acid into the bis(3-sulfopropyl)disulfide is assumed to be 100%, the upper limit concentration of the 3-mercapto-1-propanesulfonic acid in the initial aqueous solution is preferred to be 2.3 mol/L, which is twice the solubility of the bis(3-sulfopropyl)disulfide. When an initial aqueous solution containing excess amount of the 3-mercapto-1-propanesulfonic acid is converted into the bis(3-sulfopropyl)disulfide, a precipitate may generate and may affect to the properties of the finished solution as a copper plating solution. Thus, such an amount is not preferable.

Further, in the above-described initial aqueous solution, it is preferable that the concentrations of the 3-mercapto-1-propanesulfonic acid and the cupric ions satisfy the expression 3 described above. As long as expression 3 is satisfied, when the 3-mercapto-1-propanesulfonic acid and the cupric ions exist together in the initial aqueous solution, the oxidizing power resulting from the valence change of the copper ions may be utilized to promote the oxidation reaction of the 3-mercapto-1-propanesulfonic acid most effectively.

Specifically, as far as expression 3 is satisfied in the initial aqueous solution, the 3-mercapto-1-propanesulfonic acid and the cupric ions react as shown in the following formula 3, and the formation of a cuprous salt of the 3-mercapto-1-propanesulfonic acid is promoted.

$$4MPS+2Cu^{2+} \rightarrow 2Cu(I)S(CH_2)_3SO_3+SPS+4H^+ \quad \text{[Formula 3]}$$

As can be understood from the formula 3, when 0.5 mol or more of cupric ions exist against to 1 mol of the 3-mercapto-1-propanesulfonic acid, half the amount of the 3-mercapto-1-propanesulfonic acid can be converted into the bis(3-sulfopropyl)disulfide. Further, by carrying out the conversion reaction according to the reaction formula shown in the formula 4 described later, the conversion reaction of the 3-mercapto-1-propanesulfonic acid into the bis(3-sulfopropyl)disulfide may be completed.

On the other hand, when the amount of cupric ions in the initial aqueous solution is less than 0.5 mol against to 1 mol of the 3-mercapto-1-propanesulfonic acid, cuprous ions are required to be oxidized to cupric ions to react with the 3-mercapto-1-propanesulfonic acid. Therefore, the time required for the conversion reaction is made longer. The fact is obvious in the contents shown in Table 1. Table 1 shows the relationship between the concentration of the cupric ions in the initial aqueous solution and the conversion rate finally obtained. In Table 1, it can be seen that the lower the concentration of cupric ions in the initial aqueous solution, the lower the conversion rate. Further, it can be seen that when a concentration of the cupric ions decreases, the time required to finish the conversion reaction becomes longer.

TABLE 1

| MPS mol/l | F—$H_2SO_4$ g/l | $CuSO_4 \cdot 5H_2O$ mol/l | Cu concentration/ MPS concentration (Note 1) | Bubbling time min | Volume of conversion solution ml | Air flow rate l/min | Air volume vs. MPS l/mol MPS | Conversion rate % |
|---|---|---|---|---|---|---|---|---|
| 0.10 | 20 | 0.025 | 0.25 | 20 | 150 | 1.38 | 1841 | 100 |
| | | 0.015 | 0.15 | | | | | 98.8 |
| | | 0.010 | 0.10 | | | | | 90.1 |

(Note 1): Calculated value of [concentration of cupric ions (mol/l)/[concentration of 3-mercapto-1-propanesulfonic acid mol/l)

The upper limit concentration of cupric ions is not especially limited. Specifically, when copper sulfate is used as the copper supply source, concentration of the copper sulfate could be the saturation concentration at the selected solution temperature. However, if the concentration of the copper ions in the copper electrolytic solution for industrial use is considered as a standard, the upper limit in general of a concentration of the copper ions is about 120 g/L.

It is noted that the reactions in the above-described step A and in step B may also be carried out as a specific process to convert the 3-mercapto-1-propanesulfonic acid into the bis(3-sulfopropyl)disulfide to prepare a concentrated solution of the bis(3-sulfopropyl)disulfide, and then the concentrated solution is mixed with the copper electrolytic solution in step C. Specifically, the present invention should be recognized as also including a reaction system in which steps A and B are carried out simultaneously or sequentially. In addition, it should be clearly noted that the present invention includes the technical concept, for example, a practical copper plating line for an electrolytic copper plating step may be designed as following also. The 3-mercapto-1-propanesulfonic acid is directly added to a copper sulfate-containing solution, a copper electrolytic solution, and then the 3-mercapto-1-propanesulfonic acid is converted into the bis(3-sulfopropyl)disulfide in a circulation pathway of the solution in the plating apparatus, so that the conversion reaction of the 3-mercapto-1-propanesulfonic acid into the bis(3-sulfopropyl)disulfide is completed by the time the finished solution reaches to a plating cell passing through the various pipes and tanks.

Step B:

In the step B, a conversion solution in which a part or all of the above-described 3-mercapto-1-propanesulfonic acid is converted into the bis(3-sulfopropyl)disulfide is prepared by utilizing an oxidation reaction in the initial aqueous solution described above. In the step, a copper salt of the 3-mercapto-1-propanesulfonic acid reacts according to the reaction represented by the following formula 4, whole amount of the 3-mercapto-1-propanesulfonic acid may be converted into the bis(3-sulfopropyl)disulfide.

$$2Cu(I)S(CH_2)_3SO_3+SPS+4H^+ + O_2 \rightarrow 2SPS+2H_2O+2Cu^{2+} \quad \text{[Formula 4]}$$

In the Step B, it is preferable that the oxidation reaction is carried out at pH of 4 or less in the initial aqueous solution. As can be seen in formula 4, hydrogen ions are required in the oxidation reaction. Therefore, the pH of the initial aqueous solution is recommended to be a strong acid, pH of 4 or less to adjust a concentration of the hydrogen ions in the initial aqueous solution of at or above a certain level. As a result, the conversion of the copper salt of the 3-mercapto-1-propanesulfonic acid into the bis(3-sulfopropyl)disulfide proceeds rapidly. Thus, when the pH of the initial aqueous solution is more than 4, the hydrogen ion amount required for the oxidation reaction is not enough to result unsatisfied oxidation reaction processing. Further, to effectively utilize the hydrogen ions in the conversion reaction, a pH of the initial aqueous solution is more preferable to be 1.2 or less. In addition, as long as the pH is in such region, the solubility of the bis(3-sulfopropyl)disulfide is big and it enables preparation of an additive solution in high-concentration. However, no further improvement in reaction rate or in the solubility of the bis(3-sulfopropyl)disulfide is performed below a pH of 1.0. Thus, considering the safety of the preparation operation and the like, a pH of the initial aqueous solution is preferable to be 1.0 to 1.2. To adjust the solution pH in the acidic region, it is preferable to use a sulfuric acid solution.

As can be understood from formula 4, oxygen is required in the oxidation reaction. Therefore, it is preferable to use a forced oxygen introduction mean. The forced oxygen introduction mean is not only limited to just forced air blowing but also a concept including cases of using a chemical which generates oxygen in the solution.

Therefore, permanganate may be used for the oxygen generation source when inclusion of a certain amount of a foreign metal is permitted in the initial aqueous solution. Further, when a fast conversion should be performed without inclusion of a foreign metal into the initial aqueous solution, it is preferable to use hydrogen peroxide or to employ means such as forced blowing of an oxygen-containing gas like air or ozone. However, as the purpose of the oxidation reaction in the present invention is to obtain the bis(3-sulfopropyl)disulfide as a dimer of the 3-mercapto-1-propanesulfonic acid, arrangement on level for oxidizing power to be suitable is required. When the oxidizing power in the step is too strong, the 3-mercapto-1-propanesulfonic acid itself may be decomposed by oxidation to result poor conversion rate into the bis(3-sulfopropyl)disulfide. Therefore, it is preferable to selectively use a forced oxygen introduction mean capable of obtaining a suitable level of oxidizing power. Thus, it is preferable to use a reaction rate promoter such as air containing a small amount of ozone. After an oxygen-containing gas is bubbled for certain period of a time under coexistence of the cupric ions as disclosed in the present invention, the bis(3-sulfopropyl)disulfide may be obtained more stably. However, when ozone is used, an adverse effect may be occur on the electro-deposited copper film caused by the presence of the ozone in the solution. In such a case, it is preferable to employ air bubbling.

When air bubbling is employed, it is preferable to supply air in rate of 0.1 N-L/min or more with a total air supply volume which satisfies the relationship shown in the expression 4 described above. When the air bubbling is carried out, the oxidizing power obtained based on the supplied air volume is not proportional to the molar amount of the supplied air. It is because that reactivity in the step not only depends on the concentration of the 3-mercapto-1-propanesulfonic acid in the initial aqueous solution, but also affected by the size of the air bubbles during the bubbling. Therefore, in the present invention, the air bubbles in the air bubbling into the initial aqueous solution during the bubbling step are assumed to have been miniaturized by an air stone and the like conventionally used in an aquarium tank and the like. When the size of the air bubbles is larger than the estimated size of the present invention, the air volume is required to be more than the above-described range. In contrast, when the size of the air bubbles can be made smaller, the required air volume may be reduced. In the present invention, it is preferable that the flow rate of air supplied in the air bubbling is 0.1 N-L/min or more, and the total volume of air supplied against to 1 mol of the 3-mercapto-1-propanesulfonic acid in the initial aqueous solution, ([total air volume (N–L)]/amount of the 3-mercapto-1-propanesulfonic acid in the initial aqueous solution (mol)]) is 112 N-L/mol or more. The amount 112 L/mol is the total air volume required when the reaction rate between the oxygen in the air and the 3-mercapto-1-propanesulfonic acid in the initial aqueous solution is estimated to be 100%. Therefore, in the air bubbling method, if bubbling using bubbles miniaturized by a fluororesin ball filter or an air stone conventionally used in an aquarium tank and the like, it is preferable that [total air volume (L)]/amount of the 3-mercapto-1-propanesulfonic acid in the initial aqueous solution (mol)] is 1,600 L/mol or more. Further, to complete the conversion reaction in about 10 minutes, it is preferable that [total air volume (L)]/[amount of 3-mercapto-1-propanesulfonic acid in the initial aqueous solution (mol)] is 4,000 L/mol or more. Here, the upper limit is not especially limited. However, when an air is bubbled in higher flow rate, problems such as solution loss due to the formation of droplets of the solution may arise. Therefore, an upper limit of the bubbled air flow rate should be set considering certain degree of deviation in the conditions. The air volume unit N-L used here represents the volume (liters) of air at 1 atm., 0° C. (273 K).

Further, as a forced oxygen introduction mean, a method utilizing an air mixer, such as a honeycomb mixer may be installed in the circulating line of the initial aqueous solution. Moreover, the amount of the remaining 3-mercapto-1-propanesulfonic acid is preferable to be as small as possible, but the time required to complete reaction depends on the employed method. However, the time required to complete a dimerization reaction to convert the 3-mercapto-1-propanesulfonic acid into the bis(3-sulfopropyl)disulfide can be estimated by carrying out the experiments and the like in which respectively-employs a forced oxygen introduction mean.

Step C:

In the step C, a sulfuric acid base copper electrolytic solution for forming the electro-deposited copper film is prepared by adding the above-described conversion solution to a copper sulfate-containing solution. Here, the copper sulfate-containing solution used in the preparation to finish the sulfuric acid base copper electrolytic solution, a concentration of the copper ions is preferable to be 0.5 g/L to 100 g/L. Here, the copper sulfate-containing solution used to finish the sulfuric acid base copper electrolytic solution is a solution mixed with the conversion solution containing the bis(3-sulfopropyl)disulfide obtained by the conversion reaction in step B. The concentration of the copper ions of the copper sulfate-containing solution is recommended to be a concentration of the copper ions in a copper plating solution which is conventionally used in formation of an electro-deposited copper film. Therefore, the concentration of the copper ions may be arrange to be 0.5 g/L to 100 g/L which is a concentration of the copper ions of a copper plating solution used in a conventional copper plating process.

Embodiment of the Sulfuric Acid Base Copper Electrolytic Solution According to the Present Invention:

The sulfuric acid base copper electrolytic solution according to the present invention is a sulfuric acid base copper electrolytic solution which is obtained by converting a part or all of the 3-mercapto-1-propanesulfonic acid into the bis(3-sulfopropyl)disulfide by the method for preparing a sulfuric acid base copper electrolytic solution, which is characterized in that a concentration of the bis(3-sulfopropyl)disulfide is $1.4\times10^{-6}$ mol/L to $2.1\times10^{-3}$ mol/L.

The bis(3-sulfopropyl)disulfide in the sulfuric acid base copper electrolytic solution performs an effect to make the surface of the obtained electro-deposited copper film glossy. When a concentration of the bis(3-sulfopropyl)disulfide is less than $1.4\times10^{-6}$ mol/L, it may be difficult to obtain gloss on the electro-deposited copper film. On the other hand, when a concentration of the bis(3-sulfopropyl)disulfide is more than $2.1\times10^{-3}$ mol/L, the deposition of the copper tends to be unstable to result unevenness among the surface of the electro-deposited copper film. Thus, a more preferable concentration of the bis(3-sulfopropyl)disulfide is $1.4\times10^{-5}$ mol/L to $2.8\times10^{-4}$ mol/L. Here, a concentration of the bis(3-sulfopropyl)disulfide in the sulfuric acid base copper electrolytic solution can be measured by using HPLC (High Performance Liquid Chromatograph).

Further, the sulfuric acid base copper electrolytic solution according to the present invention, a concentration of the copper ions is preferable to be 0.5 g/L to 100 g/L. When the concentration of the copper ions in the sulfuric acid base copper electrolytic solution is less than 0.5 g/L, deposition of the copper may be made slow, and the surface of the deposited electro-deposited copper film tends to lose gloss. On the other hand, when the concentration of the copper ions in the sulfuric acid base copper electrolytic solution is more than 100 g/L, the solution approaches to be the saturated solution to make preparation of the solution difficult.

Further, in the sulfuric acid base copper electrolytic solution according to the present invention, it is preferable to contain 1 ppm to 150 ppm of a quaternary ammonium salt polymer having a ring structure. When a quaternary ammonium salt polymer having a ring structure is contained in a concentration of certain range together with the bis(3-sulfopropyl)disulfide, formation of a smooth and glossy electro-deposited copper film is made to be easy.

Further, for the quaternary ammonium salt polymer having a ring structure, it is preferable to use a diallyldimethylammonium chloride (hereinafter, referred to as "DDAC" in the Tables) polymer. A more preferable concentration of the diallyldimethylammonium chloride polymer is 10 ppm to 80 ppm, and an even more preferable concentration is 20 ppm to 70 ppm.

The diallyldimethylammonium chloride constructs a ring structure when to be a polymer structure, and part of the ring structure include the quaternary ammonium nitrogen atom. Further, the diallyldimethylammonium chloride polymer has a plurality of structures, such as five-membered, six-membered rings and the like. Although it depends on the synthesis conditions, it is thought that the actual polymer is either of these, or a mixture thereof. Among these polymers, a compound having a five-membered ring structure is representatively illustrated in the formula 5 below with a chloride ion as a counter ion. The diallyldimethylammonium chloride polymer has, as represented in formula 5 below, a polymer structure in which the diallyldimethylammonium chloride is a dimer or higher polymer. Further, the straight chain constituting the polymer is preferable to be a hydro-carbon.

[Formula 5]

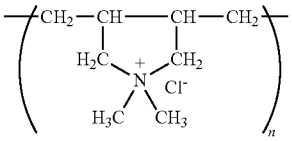

When the concentration of the diallyldimethylammonium chloride polymer in the sulfuric acid base copper electrolytic solution is less than 1 ppm, the leveling effect on the obtained electro-deposited copper film is not sufficient, and it is made difficult to obtain a surface excellent in smoothness and gloss on electro-deposited copper film even when the concentration of the bis(3-sulfopropyl)disulfide is increased. Also, when a concentration of the diallyldimethylammonium chloride polymer in the sulfuric acid base copper electrolytic solution is more than 150 ppm, the leveling effects on the deposited surface of the copper are not improved any more, and conversely the deposited state becomes unstable, so that unevenness among the surface can be seen on the electro-deposited copper film.

Further, it is preferable to make a concentration of the chloride ion in the sulfuric acid base copper electrolytic solution to be 5 ppm to 100 ppm in the condition where the diallyldimethylammonium chloride polymer has been added. The concentration of the chloride ion more preferable is 20 ppm to 60 ppm. When a concentration of the chloride ion is less than 5 ppm, the deposited surface of the electro-deposited copper film may be rough, so that a surface excellent in smoothness and gloss on the electro-deposited copper film may not be obtained. On the other hand, when a concentration of the chloride ion is more than 100 ppm, the deposited state is not stable and the deposited surface of the electro-deposited copper film may be rough, so that a surface excellent in smoothness and gloss on the electro-deposited copper film may not be obtained. Further, it is preferable to use the hydrochloric acid or the copper chloride to adjust a concentration of the chloride ion. It is not to cause a change in the nature of the sulfuric acid base copper electrolytic solution.

It should be noted that the sulfuric acid base copper electrolytic solution according to the present invention is not limited to an electrolytic solutions which contains just the above-described additives. It is because the effects may be performed in any copper electrolytic solution, as long as the solution at least contains the bis(3-sulfopropyl)disulfide. For example, a collagen or a gelatin, a polyethylene glycol, an amine compound and the like may also be used as additives to be contained.

Embodiment of the Electro-Deposited Copper Film According to the Present Invention:

The electro-deposited copper film according to the present invention is formed by using the sulfuric acid base copper electrolytic solution described above. The electro-deposited copper film formed by using the sulfuric acid base copper electrolytic solution described above has a surface excellent in smoothness and gloss. Specifically, a sulfuric acid base copper electrolytic solution will be prepared to have a concentration of the copper ions of 15 g/L to 80 g/L, a concentration of the sulfuric acid of 60 g/L to 220 g/L, a concentration of the bis(3-sulfopropyl)disulfide of $1.4\times10^{-6}$ mol/L to $2.1\times10^{-3}$ mol/L, a concentration of the diallyldimethylammonium chloride polymer of 1 ppm to 150 ppm, and a concentration of the chloride ion of 5 ppm to 100 ppm. And then, a temperature is arranged to be 20° C. to 70°, and electrolysis is performed at a cathode current density of 0.1 A/dm$^2$ to 100 A/dm$^2$. The electro-deposited copper film thus formed has a surface excellent in smoothness and gloss with less deviation within a lot and/or among lots even when copper plating is carried out on a large number of lots.

EXAMPLES

As a preliminary experiment, the relationship between the air bubbling conditions for the initial aqueous solution and the conversion rate of the 3-mercapto-1-propanesulfonic acid into the bis(3-sulfopropyl)disulfide was investigated. Specifically, sodium 3-mercapto-1-propanesulfonate, copper sulfate pentahydrate, and concentrated sulfuric acid were charged into deionized water to prepare initial aqueous solutions which have a predetermined concentrations of sodium 3-mercapto-1-propanesulfonate, concentration of the copper ions, and concentration of the free sulfuric acids as shown in Table 2, and a pH of 4 or less. Further, 100 mL or 150 mL of each initial aqueous solution was charged into a reaction vessel, a polyethylene bottle. A fluororesin ball filter with an opening diameter of 10 μm and a diameter of 25 mm is used. The air supply flow rates and bubbling times in a preliminary experiment are shown in Table 2. Then, the conversion rate of the 3-mercapto-1-propanesulfonic acid into the bis(3-sulfopropyl)disulfide for each of the conversion solutions after air bubbling was determined. The conversion rates corresponding to flow rate and the total air volume of the air supply are shown in Table 2.

ions in the conversion solutions analyzed according to the absorbance at a wavelength of 810 nm.

$$\text{Conversion rate } (\%) = \frac{(4k - 2k\alpha + \beta)}{4k} \times 100 \qquad \text{[Expression 5]}$$

α: Molar ratio of the cupric ion supplied for conversion to the MPS supplied for conversion 2kα: Amount of cupric ions (mol) supplied for conversion β: Amount of cupric ions (mol) in conversion solution 4k: Amount of MPS (mol) supplied for conversion FIG. 1 is a graph showing air volume vs. MPS (L/mol) on the X axis and conversion rate (%) on the Y axis. As is clear in FIG. 1, the conversion rate (%) linearly increases in proportional to the air volume vs. MPS (L/mol) and reach to 98.3% of conversion rate at an air volume vs. MPS of 22.7 L/mol. The result also demonstrates that the reaction rate of the oxygen in the air in the air bubbling of the Example was about 5%.

Preparation of the Conversion Solution:

To prepare the conversion solution to be used for adjustment of the concentration of the bis(3-sulfopropyl)disulfide in the sulfuric acid base copper electrolytic solution, deionized water was charged with sodium 3-mercapto-1-propanesulfonate, copper sulfate pentahydrate and concentrated sulfuric acid to finish 100 mL of an initial aqueous solution with a concentration of the sodium 3-mercapto-1-propanesulfonate of 0.1 mol/L, a concentration of the copper ions of 0.05 mol/L, and a concentration of the free sulfuric acid of 20 g/L. The pH of the initial aqueous solution finished was 1.15. The initial aqueous solution prepared was charged into the reaction vessel used in the preliminary experiment, and the air supply flow rate was set at 2.3 L/min. Air bubbling was carried out for 10 minutes by using the fluororesin ball filter described above, the conversion solution in which the 3-mercapto-1-propanesulfonic acid was converted into the bis(3-sulfopropyl)disulfide was prepared. A pH of the obtained conversion solution was 1.21.

Preparation of Sulfuric Acid Base Copper Electrolytic Solution:

The sulfuric acid base copper electrolytic solution used in the Example was prepared by adding the bis(3-sulfopropyl) disulfide (conversion solution), a diallyldimethylammonium

TABLE 2

| MPS mol/l | F—$H_2SO_4$ g/l | $CuSO_4$•$5H_2O$ mol/l | Cu concentration/ MPS concentration (Note 1) | Bubbling time min | Volume of conversion solution ml | Air flow rate l/min | Air volume vs. MPS l/mol MPS | Conversion rate % |
|---|---|---|---|---|---|---|---|---|
| 0.01 | 1 | 0.005 | 10 | 9 | 150 | 1.320 | 8280 | 99.8 |
| 0.10 | 20 | 0.050 | 0.005 | 10 | 100 | 0.012 | 12 | 53.0 |
| | | | | | | 0.098 | 97.5 | 54.9 |
| | | | | | | 0.670 | 670 | 65.0 |
| | | | | | | 1.140 | 1140 | 74.2 |
| | | | | | | 1.480 | 1480 | 83.7 |
| | | | | | | 1.870 | 1870 | 90.2 |
| | | | | | | 2.270 | 2270 | 98.3 |
| 1.12 | | 0.990 | 1.131 | 480 | 150 | 1.380 | 3930 | 100.0 |
| 2.16 | | 0.012 | 180 | 2910 | 100 | | 18592 | 99.9 |

(Note 1): Calculated value of [concentration of cupric ions (mol/l)/[concentration of 3-mercapto-1-propanesulfonic acid mol/l)

The conversion rates shown in Table 2 were calculated by using the expression 5 described below based on the formulae 3 and 4 described above by using a concentration of cupric chloride polymer (Unisence FPA 100 L, manufactured by Senka Corporation), and hydrochloric acid to a base solution prepared to be a concentration of the copper ions of 80 g/L and a concentration of the free sulfuric acid of 140 g/L. The composition of the sulfuric acid base copper electrolytic solution used in the Example and the composition of the sulfuric acid base copper electrolytic solution used in the Comparative Example are both shown in the Table 3 later.

The electro-deposited copper film was formed by using the sulfuric acid base copper electrolytic solution just after preparation by the method described above. An electro-deposited copper film with a thickness of 5 μm was formed by using the cathode, stainless steel after polishing the surface with #2000 emery paper, and the anode, DSA. Electrolysis was carried out at a solution temperature of 50° C. and a current density of 60 A/dm$^2$. In the results of visual observation of the electro-deposited copper film surface, gloss was good, and the surface was uniform. It was thus confirmed that the conversion solution obtained after air bubbling in the 3-mercapto-1-propanesulfonic acid aqueous solution performs effects similar to a bis(3-sulfopropyl)disulfide additive. The Table 4 discloses evaluation results in both the Example and the Comparative Example as shown in Table 3 to make comparison of the Example and the Comparative Example easy.

Comparative Example

Preparation of the Sulfuric Acid Base Copper Electrolytic Solution:

The base solution prepared in the Example was charged with a diallyldimethylammonium chloride polymer (Unisence FPA 100 L, manufactured by Senka Corporation), hydrochloric acid, and sodium 3-mercapto-1-propanesulfonate to prepare a sulfuric acid base copper electrolytic solution. The composition of the sulfuric acid base copper electrolytic solution used in the Comparative Example and the composition of the sulfuric acid base copper electrolytic solution used in the Example are both shown in the Table 3 below.

TABLE 3

| | Base composition | | | | | |
|---|---|---|---|---|---|---|
| | Cu (g/L) | $H_2SO_4$ (g/L) | Cl (ppm) | DDAC polymer (ppm) | SPS (mol/L) | MPS-Na (mol/L) |
| Example 1 | 80 | 140 | 30 | 70 | $7 \times 10^{-5}$ | — |
| Comparative Example 1 | | | | | — | $1.4 \times 10^{-4}$ |

TABLE 4

| | Visual gloss | Visual appearance |
|---|---|---|
| Example 1 | Good | Uniform |
| Comparative Example 1 | Matte | Uneven |

Industrial Applicability

The method for preparing the sulfuric acid base copper electrolytic solution according to the present invention is characterized in that a mono-sulfide (3-mercapto-1-propanesulfonic acid) is utilized for a additive agent for bright copper plating after converting the mono-sulfide into a disulfide (bis(3-sulfopropyl)disulfide). Therefore, the method of the present invention may be applied in ornamental copper plating and/or electrocasting applications generally forming a copper film by electrolysis using the sulfuric acid base copper electrolytic solution. In addition, in the electronic materials field, it may be applied not only for copper plating onto a printed circuit board but also for production of electro-deposited copper foil.

BRIEF DESCRIPTION OF THE DRAWING

FIG. 1 is a diagram showing the relationship between the air volume vs. MPS, air volume used in the air bubbling against to 1 mol of the 3-mercapto-1-propanesulfonic acid contained in the initial aqueous solution, and the conversion rate of the 3-mercapto-1-propanesulfonic acid into the bis(3-sulfopropyl)disulfide.

The invention claimed is:

1. A method for preparing a sulfuric acid base copper electrolytic solution, comprising:

preparing an initial aqueous solution containing 3-mercapto-1-propanesulfonic acid at a concentration of $2.8\times10^{-6}$ mol/L to 2.3 mol/L and cupric ions, wherein the relationship between the concentration of the 3-mercapto-1-propanesulfonic acid and the concentration of the cupric ions in the initial aqueous solution satisfies the Expression 1:

$$\frac{[\text{Cupric ion concentration (mol/L)}]}{[\text{3-mercapto-1-propanesulfonic acid concentration(mol/L)}]} \geq 0.005 \quad \text{(Expression 1)}$$

forming a cuprous salt of the 3-mercapto-1-propanesulfonic acid and the cupric ions as shown in the following Formula 1:

$$4MPS+2Cu^{2+}\rightarrow 2Cu(I)S(CH_2)_3SO_3+SPS+4H^+ \quad \text{(Formula 1);}$$

preparing a conversion solution by converting a part or all of the cuprous salt of the 3-mercapto-1-propanesulfonic acid into bis(3-sulfopropyl)disulfide by an oxidation reaction as shown in the following Formula 2:

$$2Cu(I)S(CH_2)_3SO_3+SPS+4H^++O_2\rightarrow 2SPS+2H_2O+2Cu^{2+} \quad \text{(Formula 2)}$$

using air in the initial aqueous solution in the presence of sulfuric acid; and preparing a sulfuric acid base copper electrolytic solution by including the conversion solution in a copper sulfate-containing solution.

2. The method for preparing a sulfuric acid base copper electrolytic solution according to claim 1, wherein the oxidation reaction is carried out at pH of 4 or less in the initial aqueous solution.

3. The method for preparing a sulfuric acid base copper electrolytic solution according to claim 1, wherein the oxidation reaction using air comprises air bubbling.

4. The method for preparing a sulfuric acid base copper electrolytic solution according to claim 3, wherein the air bubbling comprises a flow rate of supplied air of 0.1 L/min or more, and the relationship between total air volume supplied and the concentration of the 3-mercapto-1-propanesulfonic acid contained in the initial aqueous solution satisfies the Expression 2

$$\frac{[\text{Total Air Volume (L)}]}{\left[\begin{array}{c}\text{Amount of 3-mercapto-1-}\\ \text{propanesulfonic acid in}\\ \text{initial aqueous solution (mol)}\end{array}\right]} \geq 112 \text{ L/mol} \qquad \text{Expression 2}$$

5. The method for preparing a sulfuric acid base copper electrolytic solution according to claim 1, wherein a concentration of copper ions in the copper sulfate-containing solution is 0.5 g/L to 100 g/L.

6. The method for preparing a sulfuric acid base copper electrolytic solution according to claim 1, wherein the preparing an initial aqueous solution includes adding the 3-mercapto-1-propanesulfonic acid to an aqueous solution containing the cupric ions to form the initial aqueous solution.

7. The method for preparing a sulfuric acid base copper electrolytic solution according to claim 1, further comprising including a quaternary ammonium salt polymer having a ring structure in the sulfuric acid base copper electrolytic solution.

8. The method for preparing a sulfuric acid base copper electrolytic solution according to claim 7, wherein the concentration of the quaternary ammonium salt polymer having a ring structure is 1 ppm to 150 ppm.

9. The method for preparing a sulfuric acid base copper electrolytic solution according to claim 8, wherein the quaternary ammonium salt polymer having a ring structure is a diallyldimethylammonium chloride polymer.

10. The method for preparing a sulfuric acid base copper electrolytic solution according to claim 1, further comprising including chloride ion in the sulfuric acid base copper electrolytic solution, wherein the concentration of the chloride ion is 5 ppm to 100 ppm.

11. The method for preparing a sulfuric acid base copper electrolytic solution according to claim 1, wherein the preparing a sulfuric acid base copper electrolytic solution by including the conversion solution in the copper sulfate-containing solution comprises adding the conversion solution to the copper sulfate-containing solution.

* * * * *